US011969138B2

(12) United States Patent
Fang et al.

(10) Patent No.: US 11,969,138 B2
(45) Date of Patent: Apr. 30, 2024

(54) LINKAGE LIMITING ASSEMBLY APPLIED IN VACUUM CLEANER

(71) Applicant: NINGBO FUJIA INDUSTRIAL CO., LTD., Ningbo (CN)

(72) Inventors: Jianqiang Fang, Ningbo (CN); Jianming Zheng, Ningbo (CN); Wenxian Wu, Ningbo (CN)

(73) Assignee: NINGBO FUJIA INDUSTRIAL CO., LTD., Ningbo (CN)

( * ) Notice: Subject to any disclaimer, the term of this patent is extended or adjusted under 35 U.S.C. 154(b) by 118 days.

(21) Appl. No.: 17/642,230

(22) PCT Filed: Jul. 6, 2020

(86) PCT No.: PCT/CN2020/100460
§ 371 (c)(1),
(2) Date: Mar. 11, 2022

(87) PCT Pub. No.: WO2021/047265
PCT Pub. Date: Mar. 18, 2021

(65) Prior Publication Data

US 2022/0313039 A1 Oct. 6, 2022

(30) Foreign Application Priority Data

Sep. 11, 2019 (CN) ..... 201921509870.6

(51) Int. Cl.
*A47L 9/14* (2006.01)
*A47L 9/22* (2006.01)

(52) U.S. Cl.
CPC ..... *A47L 9/149* (2013.01); *A47L 9/1409* (2013.01); *A47L 9/22* (2013.01)

(58) Field of Classification Search
CPC ..... A47L 9/149; A47L 9/1409; A47L 9/22; A47L 9/1691; A47L 9/1427; Y10T 403/593; Y10T 403/599; Y10T 403/602
USPC ..... 15/347
See application file for complete search history.

(56) References Cited

FOREIGN PATENT DOCUMENTS

| | | | |
|---|---|---|---|
| EP | 1917896 | A1 | 5/2008 |
| JP | S53120850 | * | 10/1978 |
| JP | S53120850 | A | 10/1978 |
| JP | S5418507 | A | 2/1979 |
| JP | 200867930 | A | 3/2008 |

OTHER PUBLICATIONS

International Search Report issued in corresponding International application No. PCT/CN2020/100460, dated Sep. 29, 2020.

(Continued)

*Primary Examiner* — Laura C Guidotti
*Assistant Examiner* — Caleb Andrew Holizna

(57) ABSTRACT

Disclosed is a linkage limiting assembly applied in a vacuum cleaner, which is mounted within a frame of the vacuum cleaner. The linkage limiting assembly includes a triggering button arranged at the rear end of the frame, a pushing member configured to push an electric fan assembly or a dust barrel of the vacuum cleaner upwards, a limiting member configured to limit the maximum stroke of the electric fan assembly or the dust barrel, and a linking member connecting the triggering button with the limiting member in a force transmission manner.

5 Claims, 4 Drawing Sheets

(56) References Cited

OTHER PUBLICATIONS

Written Opinion of the International Search Authority in corresponding International application, No. PCT/CN2020/100460, dated Sep. 29, 2020.
Japan Office Action, Japan Application No. JP2022516201, dated May 24, 2023.
European Search Report, European Application No. EP20863188.7, dated Sep. 6, 2023.

* cited by examiner

LINKAGE LIMITING ASSEMBLY APPLIED IN VACUUM CLEANER

TECHNICAL FIELD

The present disclosure relates to the technical field of vacuum cleaners, and particularly to a linkage limiting assembly applied in a vacuum cleaner.

BACKGROUND

At present, opening a dust barrel in a vacuum cleaner and removing dust from the dust barrel are extremely complicated. The dust barrel available in the market mainly includes an overall disassembly type dust barrel and a front flip type dust barrel, wherein for the front flip type dust barrel, a buckling portion is required to be manually opened to realize that a front cover is flipped and opened, which is inconvenient. Therefore, there is a need for a linkage mechanism capable of easily moving the dust barrel, so as to realize that a user can release a limiting state of an electric fan assembly or a dust barrel instantly in a case where the user holds the frame of the vacuum cleaner and push the electric fan assembly or the dust barrel to flip upwards, to realize an action of removing dust instantly in combination with a dust cover that can be opened automatically.

SUMMARY

In view of the problems mentioned in the prior art, provided is a method, which aims to enable a user to press a triggering button with the thumb while holding a vacuum cleaner frame to release a limiting state of an electric fan assembly or a dust barrel instantly, and push a linkage limiting assembly applied in a vacuum cleaner to upwards move, to overcome the above-mentioned technical defects.

Specific technical solutions are described below.

A linkage limiting assembly applied in a vacuum cleaner is mounted within a frame of the vacuum cleaner. The linkage limiting assembly includes a triggering button arranged at the rear end of the frame, a pushing member configured to push an electric fan assembly or a dust barrel of the vacuum cleaner upwards, a limiting member configured to limit the maximum stroke of the electric fan assembly or the dust barrel, and a linking member connecting the triggering button with the limiting member in a force transmission manner.

Preferably, the electric fan assembly or the dust barrel has a buckling structure opposite to the limiting member at a lower end thereof, the limiting member is mounted within the frame and is rotatable back and forth, and one end of the linking member away from the triggering button abuts against the limiting member for driving the limiting member to perform a rotating action; and one side of the limiting member facing the buckling structure has a first flange buckling portion for limiting the minimum stroke of the buckling structure, and the frame has a second flange buckling portion inside for limiting the maximum stroke of the buckling structure.

Preferably, the buckling structure has a buckle at a lower end thereof, and the first flange buckling portion and the second flange buckling portion have stepped structures at lower end faces thereof corresponding to the buckling structure in shape.

Preferably, a first spring is embedded within the frame, and two ends of the first spring respectively abut against the inner wall of the frame and one side of the limiting member away from the buckling structure.

Preferably, the pushing member includes a pushing sleeve, wherein the pushing sleeve has an opening at a lower end thereof and a second spring is embedded within the opening.

Preferably, the linking member is U-shaped, and one end of a branch of the linking member abuts against the limiting member and the other end thereof is connected with the triggering button; and a third spring abuts against the inner side of the linking member, and the other end of the third spring abuts against a bracket structure within the frame.

The technical solutions have the following beneficial effects.

The linkage limiting assembly applied in the vacuum cleaner includes the triggering button, the pushing member, the limiting member and the linking member, such that the user can press the triggering button with the thumb while holding the frame of the vacuum cleaner to release the limiting state of the electric fan assembly or the dust barrel instantly and push the electric fan assembly or the dust barrel to move upwards, which is in excellent in linking effect and brings the convenience for operation.

DESCRIPTION OF THE EMBODIMENTS

Figure 1:
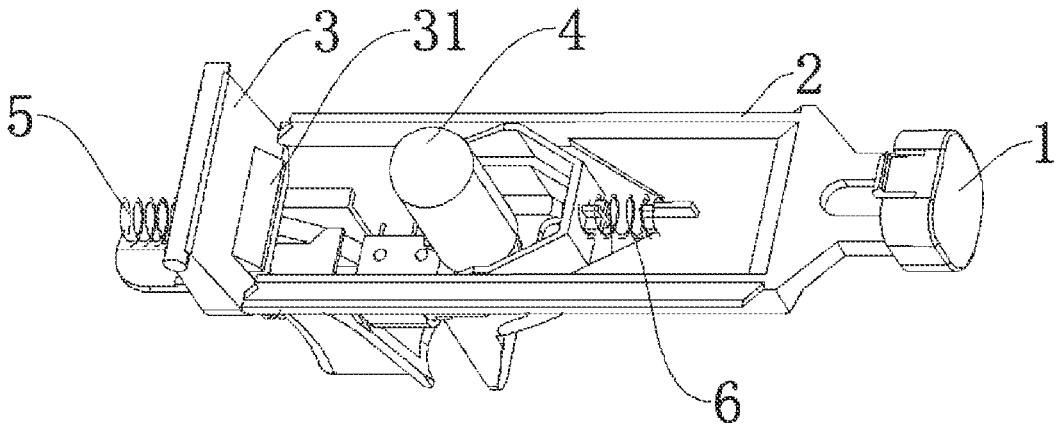
FIG. 1 is a perspective view of a linkage limiting assembly applied in a vacuum cleaner according to the present disclosure.
Figure 2:
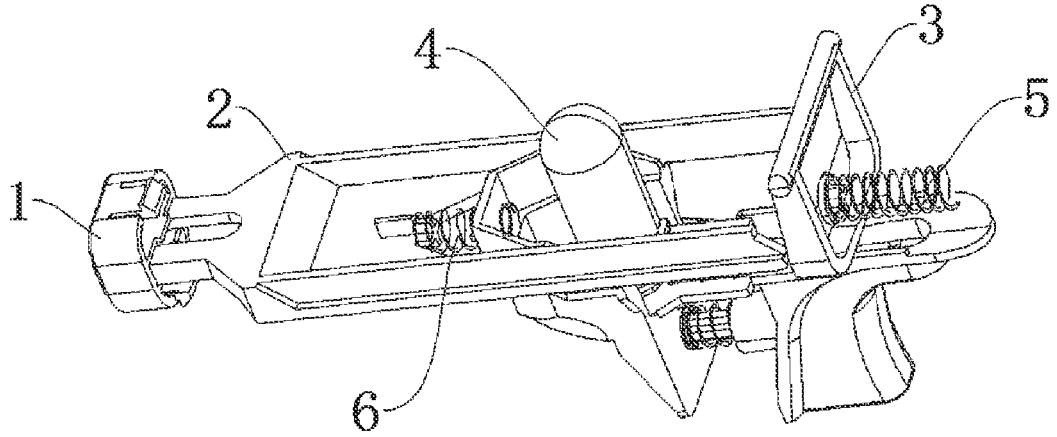
FIG. 2 is a perspective view of a linkage limiting assembly applied in a vacuum cleaner from a different aspect according to the present disclosure.
Figure 3:
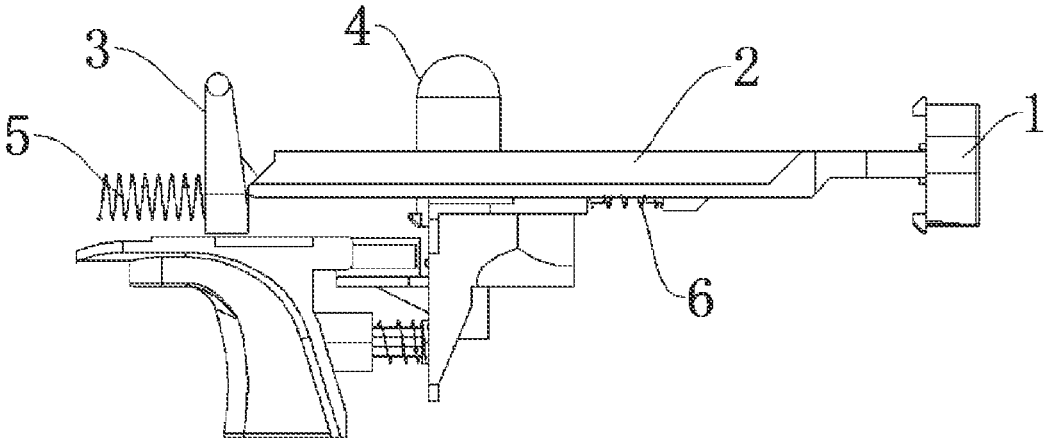
FIG. 3 is a side view of a linkage limiting assembly applied in a vacuum cleaner according to the present disclosure.
Figure 4:
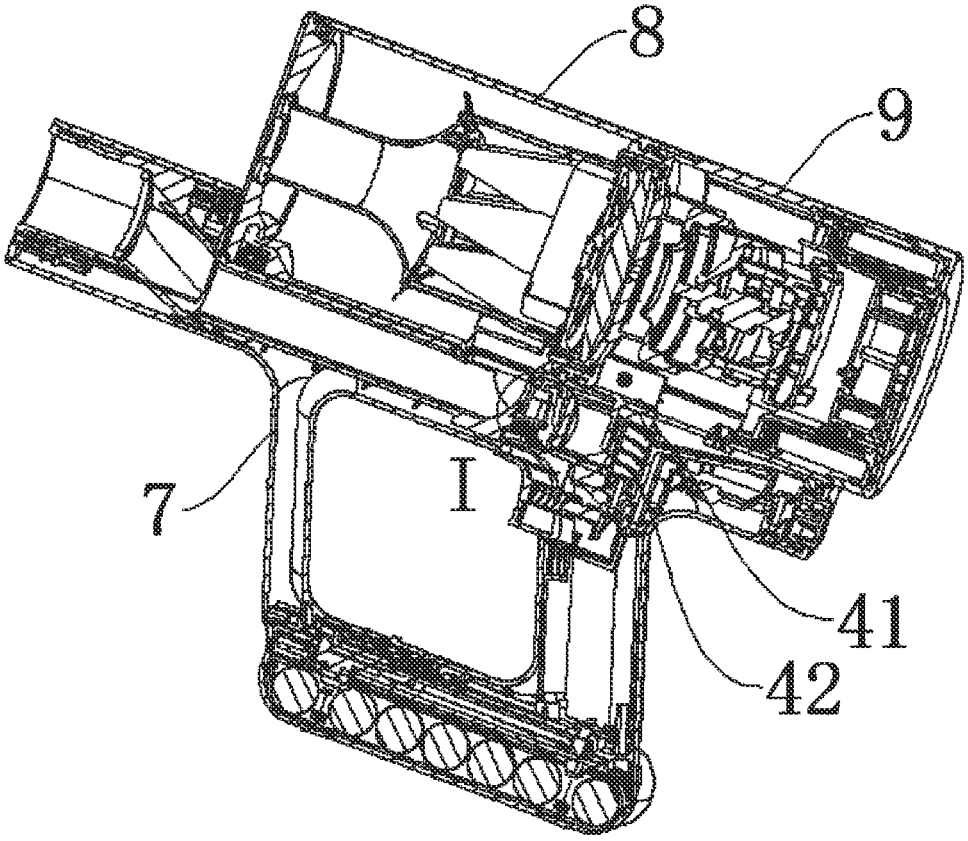
FIG. 4 is a cross-sectional perspective view of a specific application of a linkage limiting assembly applied in a vacuum cleaner according to the present disclosure.
Figure 5:
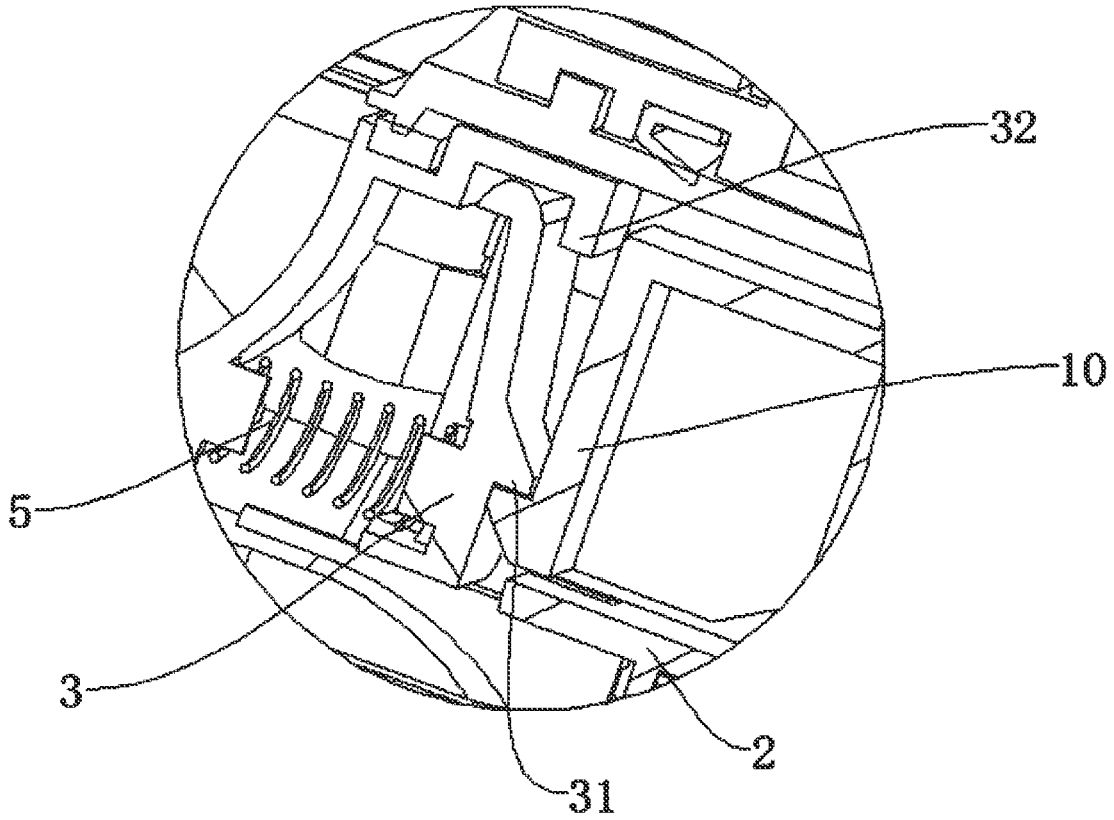
FIG. 5 is a partial enlarged view showing a portion I in FIG. 4.

In order to easily understand technical means, creation features, achieved goals and effects of the present disclosure, the following embodiments will specifically describe the present disclosure in conjunction with accompanying drawings.

With reference to FIG. 1 to FIG. 6, the linkage limiting assembly applied in a vacuum cleaner provided by the present disclosure is mounted within a frame 7 of the vacuum cleaner. The linkage limiting assembly includes a triggering button 1 arranged at a rear end of the frame 7, a pushing member 4 configured to push an electric fan assembly 9 or a dust barrel 8 of the vacuum cleaner upwards, a limiting member 3 configured to limit the maximum stroke of the electric fan assembly 9 or the dust barrel 8, and a linking member 2 connecting the triggering button 1 with the limiting member 3 in a force transmission manner.

Based on the above technical solution, the linkage limiting assembly applied in the vacuum cleaner includes the triggering button 1, the pushing member 4, the limiting member 3 and the linking member 2, such that the user can press the triggering button 1 with the thumb while holding the frame 7 of the vacuum cleaner to release the limiting state of the electric fan assembly 9 or the dust barrel 8 instantly and push the electric fan assembly 9 or the dust barrel 8 to move upwards, which is in excellent in linking effect and brings the convenience for operation.

In a preferred embodiment, the electric fan assembly 9 or the dust barrel 8 has a buckling structure 10 opposite to the limiting member 3 at a lower end thereof, the limiting member 3 is mounted within the frame and is rotatable back and forth, and one end of the linking member 2 away from the triggering button 1 abuts against the limiting member 3 for driving the limiting member 3 to perform a rotating action. One side of the limiting member 3 facing the buckling structure 10 has a first flange buckling portion 31 for limiting the minimum stroke of the buckling structure 10, and the frame 7 has a second flange buckling portion 32 inside for limiting the maximum stroke of the buckling structure 10. Specifically, the buckling structure 10 has a buckle at a lower end thereof, and the first flange buckling portion and the second flange buckling portion have stepped structures at lower end faces thereof corresponding to the buckling structure 10 in shape.

Figure 6:
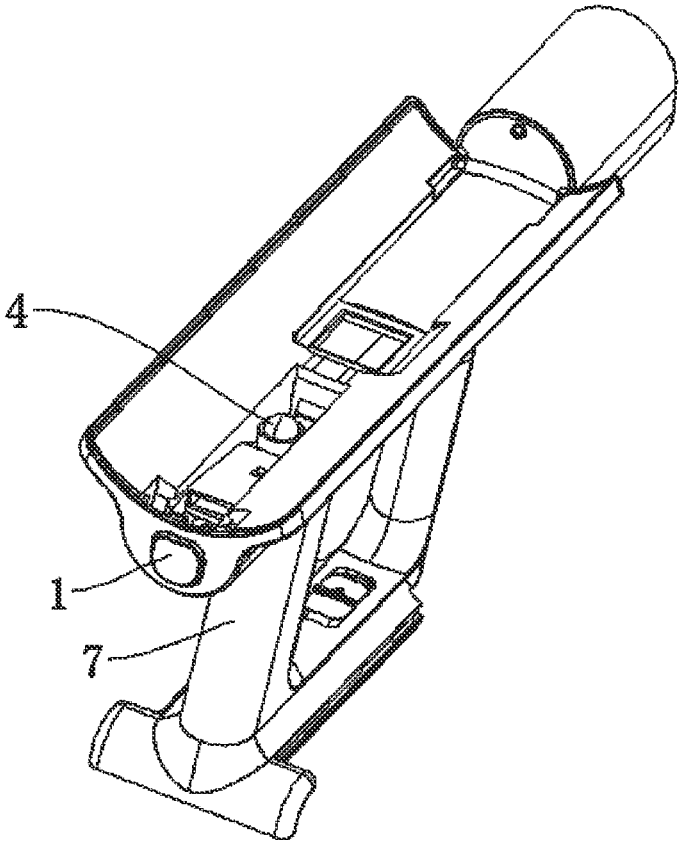
FIG. 6 is a perspective view showing a frame in a specific application of a linkage limiting assembly applied in a vacuum cleaner according to the present disclosure.

As a further preferred embodiment, a first spring 5 is embedded within the frame 7, and two ends of the first spring 5 respectively abut against the inner wall of the frame 7 and one side of the limiting member 3 away from the buckling structure 10. Further, the pushing member 4 includes a pushing sleeve 41, wherein the pushing sleeve 41 has an opening at a lower end thereof and a second spring 42 is embedded within the opening, for driving the pushing sleeve 41 to push the dust barrel 8 or the electric fan assembly 9 by means of the second spring 42. Moreover, the first spring 5 and the second spring 42 may be replaced by an apparatus such as a plastic elastic column. The pushing member 4 may be an integral elastic column, which is not limited thereto. Meanwhile, it is worth noting that, as shown in FIG. 6, the frame 7 has openings for the components described above to protrude upwards, which is relatively conventional. Accordingly, the detailed description will be omitted here.

As a further preferred embodiment, the linking member 2 is U-shaped, and one end of a branch of the linking member 2 abuts against the limiting member 3 and the other end thereof is connected with the triggering button 1; and a third spring 6 abuts against the inner side of the linking member 2, and the other end of the third spring 6 abuts against a bracket structure within the frame 7, such that the third spring 6 drives the linking member 2 to perform a resetting action after the triggering button 1 is released.

Specifically, the linkage limiting assembly is mainly applied to the vacuum cleaner with the dust barrel 8 capable of automatically opening and closing a dust cover. The dust barrel 8 or the electric fan assembly 9 is pushed to flip by means of a linking action of the linkage limiting assembly, such that the dust cover is unlocked after the action and automatically opened, so as to realize the operation of removing dust instantly.

The above descriptions are only preferred embodiments of the present disclosure, which are merely illustrative rather than restrictive for the present disclosure. Those skilled in the art shall understand that many changes, modifications and even equivalents can be made within the spirit and scope defined by the claims of the present disclosure, but all fall within the protective scope of the present disclosure.

What is claimed is:

1. A linkage limiting assembly applied in a vacuum cleaner, which is mounted within a frame of the vacuum cleaner, wherein the linkage limiting assembly comprises a triggering button arranged at a rear end of the frame, a pushing member configured to push an electric fan assembly or a dust barrel of the vacuum cleaner upwards, a limiting member configured to limit a maximum stroke of the electric fan assembly or the dust barrel, and a linking member connecting the triggering button with the limiting member in a force transmission manner, wherein the electric fan assembly or the dust barrel has a buckling structure at a lower end thereof opposite to the limiting member, the limiting member is mounted within the frame and is rotatable back and forth, and one end of the linking member away from the triggering button abuts against the limiting member for driving the limiting member to perform a rotating action; and one side of the limiting member facing the buckling structure has a first flange buckling portion for limiting a minimum stroke of the buckling structure, and the frame has a second flange buckling portion inside for limiting a maximum stroke of the buckling structure.

2. The linkage limiting assembly applied in the vacuum cleaner according to claim 1, wherein the buckling structure has a buckle at a lower end thereof, and the first flange buckling portion and the second flange buckling portion each have a step structure at a respective lower end face thereof corresponding to the buckling structure in shape.

3. The linkage limiting assembly applied in the vacuum cleaner according to claim 1, wherein a spring is embedded within the frame, and two ends of the spring respectively abut against an inner wall of the frame and one side of the limiting member away from the buckling structure.

4. A linkage limiting assembly applied in a vacuum cleaner, which is mounted within a frame of the vacuum cleaner, wherein the linkage limiting assembly comprises a triggering button arranged at a rear end of the frame, a pushing member configured to push an electric fan assembly or a dust barrel of the vacuum cleaner upwards, a limiting member configured to limit a maximum stroke of the electric fan assembly or the dust barrel, and a linking member connecting the triggering button with the limiting member in a force transmission manner, wherein the pushing member comprises a pushing sleeve, wherein the pushing sleeve has an opening at a lower end thereof and a spring is embedded within the opening.

5. A linkage limiting assembly applied in a vacuum cleaner, which is mounted within a frame of the vacuum cleaner, wherein the linkage limiting assembly comprises a triggering button arranged at a rear end of the frame, a pushing member configured to push an electric fan assembly or a dust barrel of the vacuum cleaner upwards, a limiting member configured to limit a maximum stroke of the electric fan assembly or the dust barrel, and a linking member connecting the triggering button with the limiting member in a force transmission manner, wherein the linking member is U-shaped, and one end of a branch of the linking member abuts against the limiting member and an other end of the linking member is connected with the triggering button; a spring abuts against an inner side of the linking member, and an other end of the spring abuts against a bracket structure within the frame.

* * * * *